US009057255B2

(12) United States Patent
Juenke

(10) Patent No.: US 9,057,255 B2
(45) Date of Patent: Jun. 16, 2015

(54) DUAL FLOW GAS LIFT VALVE

(75) Inventor: Michael S. Juenke, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 664 days.

(21) Appl. No.: 13/270,254

(22) Filed: Oct. 11, 2011

(65) Prior Publication Data

US 2013/0087343 A1 Apr. 11, 2013

(51) Int. Cl.
*E21B 43/12* (2006.01)

(52) U.S. Cl.
CPC ..... *E21B 43/123* (2013.01)

(58) Field of Classification Search
CPC ... E21B 43/122; E21B 43/123; E21B 43/166; E21B 43/168; E21B 43/129
USPC ..... 166/319, 372, 321, 325; 137/155
See application file for complete search history.

(56) References Cited

U.S. PATENT DOCUMENTS

| | | | | |
|---|---|---|---|---|
| 4,239,082 | A * | 12/1980 | Terral | 166/117.5 |
| 4,554,972 | A | 11/1985 | Merritt | |
| 4,813,730 | A | 3/1989 | Terrall | |
| 5,066,198 | A | 11/1991 | Decker | |
| 5,267,469 | A | 12/1993 | Espinoza | |
| 5,425,425 | A | 6/1995 | Bankston et al. | |
| 5,533,572 | A * | 7/1996 | Brady et al. | 166/250.05 |
| 6,237,692 | B1 * | 5/2001 | Averhoff | 166/372 |
| 7,147,059 | B2 | 12/2006 | Hirsch et al. | |
| 7,198,099 | B2 | 4/2007 | Lugtmeier et al. | |
| 7,464,763 | B2 | 12/2008 | Galloway et al. | |
| 7,735,557 | B2 * | 6/2010 | Mailand et al. | 166/305.1 |
| 7,784,553 | B2 * | 8/2010 | Moreno | 166/386 |
| 2002/0070369 | A1 | 6/2002 | Faustinelli | |
| 2003/0024704 | A1 | 2/2003 | Hirsch et al. | |
| 2003/0164240 | A1 | 9/2003 | Vinegar et al. | |
| 2005/0056431 | A1 | 3/2005 | Harrington et al. | |
| 2005/0087337 | A1 | 4/2005 | Brisco et al. | |
| 2010/0096142 | A1 * | 4/2010 | Randazzo | 166/373 |
| 2013/0312833 | A1 * | 11/2013 | Salihbegovic | 137/1 |

OTHER PUBLICATIONS

Weatherford, "RF Series Production Pressure-Operated Valves," Brochure, copyright 2008.
Weatherford, "RF Series IPO Gas Lift Valves," Brochure, copyright 2005.
Weatherford, "Tubing-Retrievable (Conventional) Injection Pressure-Operated Gas-Lift Valves," Brochure, copyright 2005.
Weatherford, "Tubing-Retrievable, Injection Pressure, Pilot-Operated Gas-Lift Valves," Brochure, copyright 2005.

(Continued)

*Primary Examiner* — Shane Bomar
*Assistant Examiner* — David Carroll
(74) *Attorney, Agent, or Firm* — Wong, Cabello, Lutsch, Rutherford & Brucculeri LLP

(57) ABSTRACT

A gas lift system has mandrels deploying downhole and has gas lift valves deploying on the mandrels. In general, the mandrel can have an interior and can have at least one port communicating outside the mandrel. To achieve higher gas injection while maintaining component sizes in desirable ranges, the gas lift valve of the present disclosure has multiple injection outlets, and a common opening pressure can control the opening of each of the injection outlets in the valve. The valve can open in two places, allowing gas to flow through the nose of the valve as well as through a ported latch at the top of the valve. In this way, that valve can offer larger injection capabilities while keeping a suitable outside diameter.

7 Claims, 7 Drawing Sheets

(56) References Cited

OTHER PUBLICATIONS

Lufkin, "Gas Lift Systems," Catalog, copyright 2011.
Production Control Services, "Opti-Flow Gas Lift Equipment Catalog," Catalog, dated Dec. 2, 2010.
BST Lift Systems, Inc., "EBK-2," obtained from http://www.bstlift.com/ebk-2.htm, generated Oct. 6, 2011, copyright 2003.
BST Lift Systems, Inc., "BK-2," obtained from http://www.bstlift.com/bk-2.htm, generated Oct. 6, 2011, copyright 2003.

* cited by examiner

DUAL FLOW GAS LIFT VALVE

BACKGROUND

To obtain hydrocarbon fluids from an earth formation, a wellbore is drilled into an area of interest within a formation. The wellbore may then be "completed" by inserting casing in the wellbore and setting the casing using cement. Alternatively, the wellbore may remain uncased as an "open hole," or it may be only partially cased. Regardless of the form of the wellbore, production tubing is run into the wellbore to convey production fluid (e.g., hydrocarbon fluid, which may also include water) to the surface.

Often, pressure within the wellbore is insufficient to cause the production fluid to naturally rise through the production tubing to the surface. In these cases, an artificial lift system can be used to carry the production fluid to the surface. One type of artificial lift is a gas lift system, of which there are two primary types: tubing-retrievable gas lift systems and wireline-retrievable gas lift systems. Each type of gas lift system uses several gas lift valves spaced along the production tubing. The gas lift valves allow gas to flow from the annulus into the production tubing so the gas can lift production fluid in the production tubing. Yet, the gas lift valves prevent fluid to flow from the production tubing into the annulus.

In gas lift, high-pressure gas is injected into the production conduit of the well in a continuous fashion to reduce the backpressure on the formation by reducing the hydrostatic load of the production fluid. Gas lift can also be used in a cyclic manner to displace well fluid to the surface by displacing a fluid slug with an expanding high-pressure gas bubble that lifts the slug to the surface. A major component in a gas lift system is the gas lift valve. The gas lift valve is used to communicate the injection gas form the annulus into the tubing string. Various types of gas lift valves exist to meet various operating parameters of the well.

A typical wireline-retrievable gas lift system 10 is shown in FIG. 1. Operators inject compressed gas G into the annulus 22 between a production tubing string 20 and the casing 24 within a cased wellbore 26. A valve system 12 supplies the injection gas G from the surface and allows produced fluid to exit the gas lift system 10.

Side pocket mandrels 30 spaced along the production string 20 hold gas lift valves 40 within side pockets 32. As noted previously, the gas lift valves 40 are one-way valves that allow gas flow from the annulus 22 into the production string 20 and prevent gas flow from the production string 20 into the annulus 22.

In operation, the production fluid P flows from the formation into the wellbore 26 through casing perforations 28 and then flows into the production tubing string 20. A production packer 14 located on the production string 20 forces the flow of production fluid P from a formation up through the production string 20 instead of up through the annulus 22. When it is desired to lift the production fluid P, compressed gas G is introduced into the annulus 22. The production packer 14 forces the gas flow from the annulus 22 into the production string 20 through the gas lift valves 40. In particular, the gas G enters from the annulus 22 through ports 34 in the mandrel's side pockets 32. Disposed inside the side pockets 32, the gas lift valves 40 then control the flow of injected gas I into the production string 20. As the injected gas I rises to the surface, it helps to lift the production fluid P up the production string 20 to the surface.

A typical gas lift valve 40A used in the art for a wireline-retrievable system is shown in FIG. 2A. The gas-lift valve 40A has upper and lower seals 44*a-b* separating vale ports 46, which communicate with injection gas ports 48. A valve piston 52 is biased closed by a gas charge dome 50 and a bellows 56. At its distal end, the valve piston 52 moves relative to a valve seat 54 at the valve ports 46 in response to pressure on the bellows 56 from the gas charge dome 50. A predetermined gas charge applied to the dome 50 and bellows 56 therefore biases the valve piston 52 against the valve seat 54 and close the valve ports 46.

A check valve 58 in the gas-lift valve 40 is positioned downstream from the valve piston 52, valve seat 54, and valve ports 46. The check valve 58 keeps flow from the production string (not shown) from going through the injection ports 48 and back into the casing (annulus) through the valve ports 46. Yet, the check valve 58 allows injected gas from the valve ports 46 to pass out the gas injection ports 48.

An alternative type of gas lift valve 40B is shown in FIG. 2B. This valve 40B is similar to that disclosed in U.S. Pat. Pub. No. 2010/0096142, entitled "Gas-Lift Valve and Method of Use." Briefly, this valve 40B is like an inverted form of the typical gas-lift valve. The valve 40B has inlet ports 46 and a valve seat 54. However, the valve's outlet port 43 is disposed at the upper end of the valve 40B as opposed to being at the downhole end. A tubular latch 42 at the top of the valve 40B has a removable plug (not shown) that can dispose in the outlet port 43.

Internally, the valve 40B has a gas charged dome 50, a valve ball member 52, and a bellows 56 positioned below the valve seat 54, as opposed to disposing in the traditional arrangement above the valve seat. The purpose of this inverted gas lift valve 40B is to redirect the injection gas out of the valve's uphole outlet 43 in an upward direction so the injected gas flows along with the natural flow of the tubing string. This upward injection is believed to increase production.

Other types of downhole devices, which are not gas lift valves, can install in side pocket mandrels. For example, "dummy" valves can install in the side pocket of a mandrel. These dummy valves are not actually valves because they merely dispose in the mandrel to seal of the mandrel's ports so pressure testing can be performed.

As shown in FIG. 3, a circulating device 40C is another device that can dispose in a mandrel downhole. Similar to an RC-1 DC circulating device available from Weatherford International, the circulating device 40C has inlets 46 at a central portion of the device's housing. Upper and lower outlets 41*a-b* on the device 40C communicate with these central inlets 46, and packing seals 44*a-b* disposed about the device 40C isolate the inlets 46 when installed in a mandrel.

Internally, the circulating device 40C lacks loaded valve mechanisms and instead merely has check darts 45*a-b* and seats 47*a-b*. Fluids entering the inlets 46 from a borehole annulus can pass the check darts 45*a-b* and seats 47*a-b* and can proceed unhindered out the outlets 41*a-b*. The check darts 45*a-b* simply restrict reverse flow from the tubing past the seats 47*a-b*. Being unloaded, this device 40C is essentially not capable of closing off inlet flow so it cannot be used as an unloading valve of injected gas in a gas lift operation.

High rate wells typically need high gas volumes for gas lift to work. To meet this need, the gas lift system must inject very large volumes of gas so gas lift valves with large injection ports are used. Understandably, the size of the gas lift valve limits the available size for the injection ports so that larger and larger valve sizes are needed to provide the required larger injection ports. Ultimately, the size of the production casing and size of the tubing string limits the size of the gas lift valve that can be used.

As an additional problem, high rate wells require large tubing sizes to produce efficiently. The increased tubing size reduces the amount of available room between the production casing and tubing string and limits the size of the gas lift valves that can be installed. In fact, gas lift valves that can meet large injection volumes are being manufactured that prove difficult to fit into the completion.

In some situations in a high rate well, an operator has to run smaller valves (i.e., a valve having 1-in. OD) downhole because of the casing clearance in the borehole. To improve gas injection, the operator runs a mandrel with multiple pockets or runs two standard mandrels separated by a joint of pipe on the tubing string in the borehole. In this way, the smaller valves installed in the pockets of the mandrel(s) can provide double the gas passage. As expected, the multiple valves, pockets, and mandrels significantly complicates servicing the completion.

The subject matter of the present disclosure is directed to overcoming, or at least reducing the effects of, one or more of the problems set forth above.

SUMMARY

As noted previously, high rate wells need high gas volumes for gas lift to work and also require large tubing sizes to produce efficiently. A gas lift system disclosed herein has increased gas injection capabilities, but does not require an increased outside diameter for the gas lift valve. In this way, the gas lift system can maintain a minimal mandrel running diameter. This minimal running diameter can make the gas lift system useful for slimhole completions. However, standard completions that require large amounts of injection gas that cannot pass conventional 1½" OD valves will also benefit from the disclosed gas lift system.

The disclosed gas lift system has mandrels deploying downhole and has gas lift valves disposed on the mandrels. The gas lift valve can be a wireline-retrievable gas lift valve that disposes in a side pocket mandrel. Alternatively, the gas lift valve can be a tubing retrievable gas lift valve disposed on any conventional mandrel (even a mandrel with an external mount for the gas lift valve).

In general, the mandrel can have an interior and can have at least one port communicating outside the mandrel. To achieve higher gas injection while maintaining component sizes in desirable ranges, the gas lift valve of the present disclosure has multiple injection ports, and a common opening pressure can control the opening of each of the injection ports in the valve. The valve can open in two places, allowing gas to flow through the nose of the valve as well as through the top of the valve (i.e., at a ported latch if present). In this way, the valve can offer larger injection capabilities while keeping a suitable outside diameter.

In particular, the gas lift valve has a housing sealingly deployed in the mandrel's interior. For example, chevron or other seals disposed on the outside of the housing can engage against the mandrel. The housing has at least one inlet in fluid communication with at least one port in the mandrel that communicates with the annulus of the wellbore. This at least one inlet receives the injected gas entering the mandrel from the annulus through the mandrel's at least one port.

To inject gas into the mandrel's interior, the housing has first and second outlets in fluid communication with the mandrel's interior. A first valve mechanism disposed in the housing controls passage of inlet fluid from the at least one inlet to the first outlet, and a second valve mechanism disposed in the housing controls passage of the inlet fluid from the at least one inlet to the second outlet.

When wireline retrievable, the valve can have a latch mechanism disposed on the housing, and the latch mechanism can have a port communicating with the valve's second outlet. The port can be permanently open or can be plugged and later opened. For example, the latch mechanism can have a plug removably disposed in the port for the second outlet, and operators can remove the plug to convert the gas lift valve from single outlet injection to dual outlet injection. Although the plug may be useful in some applications, the removable plug may not be necessary given the implementation and intended operation of the valve.

The valve mechanisms can include a seat disposed between the valve's inlet and outlet and can include a valve member biased relative to the seat. The valve member restricts passage of the inlet fluid through the seat by moving a piston with a bellows subjected to differential pressure between a dome volume pressure and inlet pressure. To prevent backflow into the valve, check valves are disposed at each of the outlets restricting fluid communication back into the valve.

As noted above, the valve members can each have a bellows biasing the valve member relative to the seat. The housing defines at least one pressure chamber in fluid communication with these bellows. As an alternative to the pressure chamber, the valve can be spring loaded and not use a dome charge. Moreover, the valve can use a combination of a spring load and a pressure chamber. Depending on the desired configuration, the two valve mechanisms in the valve can operate in tandem or can operate differently to produce different gas injection rates.

The foregoing summary is not intended to summarize each potential embodiment or every aspect of the present disclosure.

DETAILED DESCRIPTION

Figure 1:
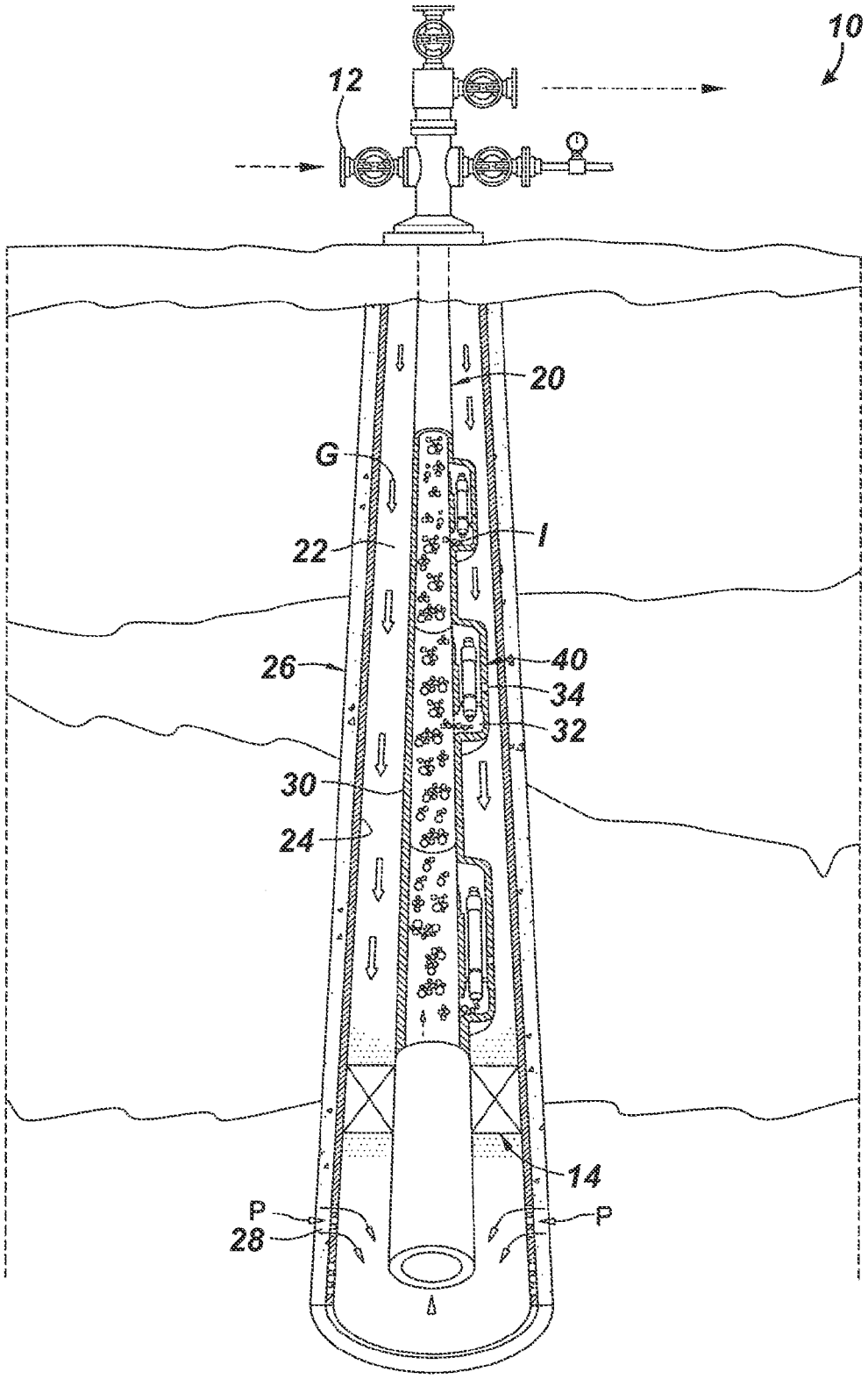
FIG. 1 (Prior Art)
FIG. 1 illustrates a gas lift system according to the prior art.
Figure 2A:
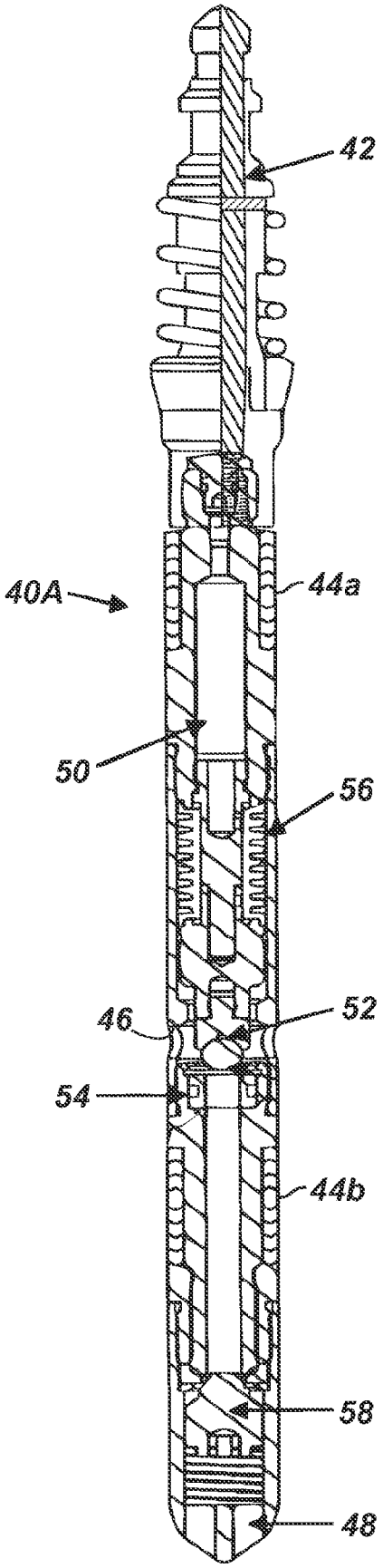
FIG. 2A (Prior Art)
FIG. 2A is a cross-section of a gas lift valve according to the prior art.
Figure 2B:
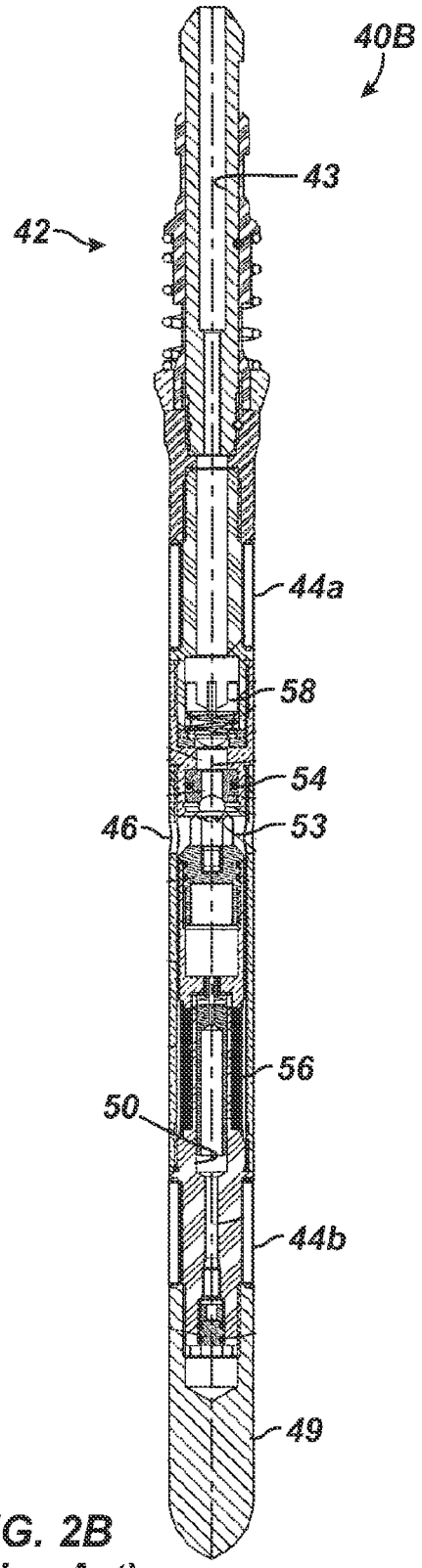
FIG. 2B (Prior Art)
FIG. 2B is a cross-section of an inverted style gas lift valve according to the prior art.
Figure 3:
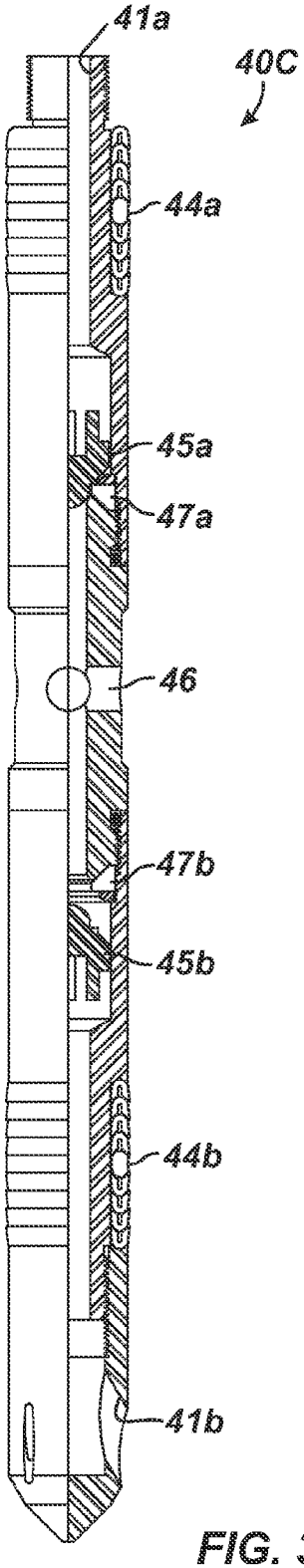
FIG. 3 (Prior Art)
FIG. 3 is a cross-section of a dual flow circulating device according to the prior art.
Figure 4A:
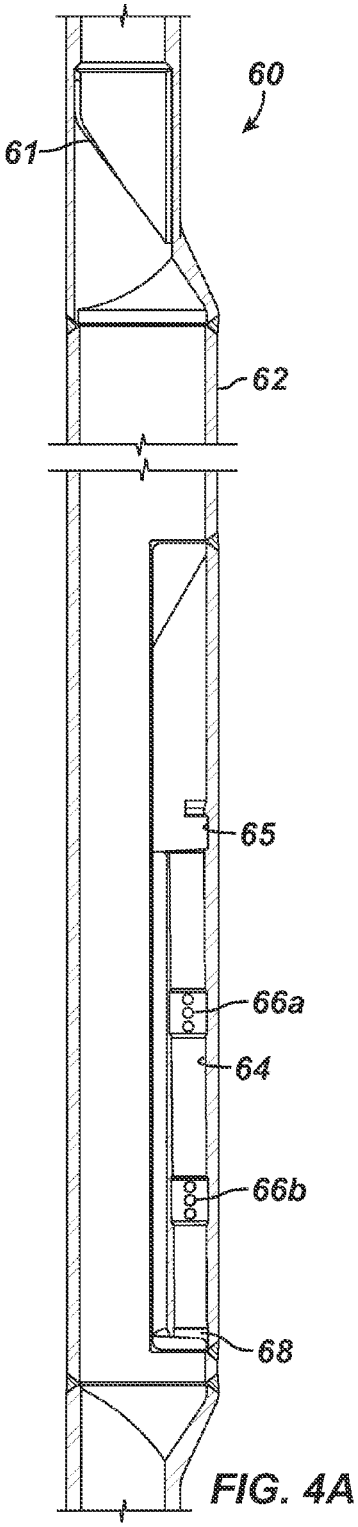
FIG. 4A shows a mandrel for a gas lift system according to the present disclosure.
Figure 4B:
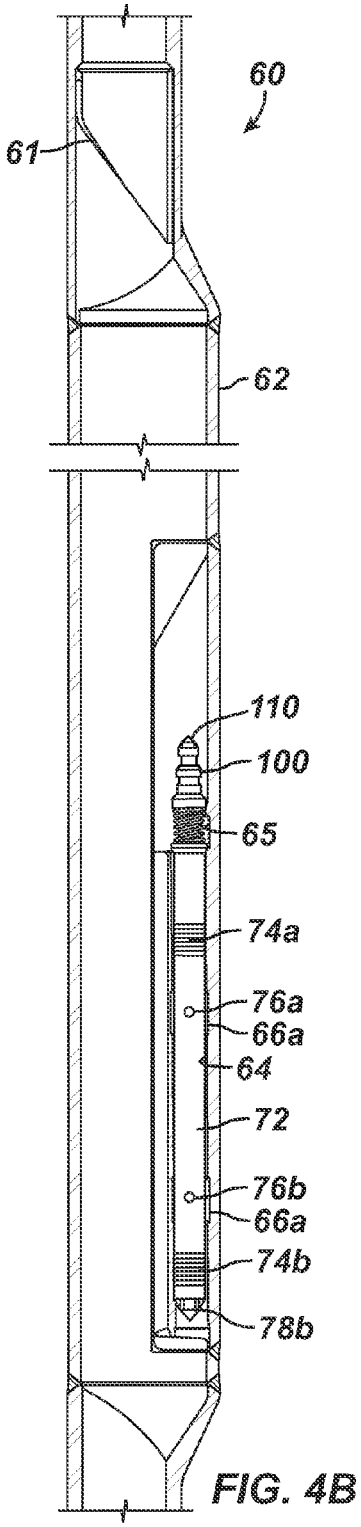
FIG. 4B shows a gas lift valve of the present disclosure deployed in the mandrel.
Figure 4C:
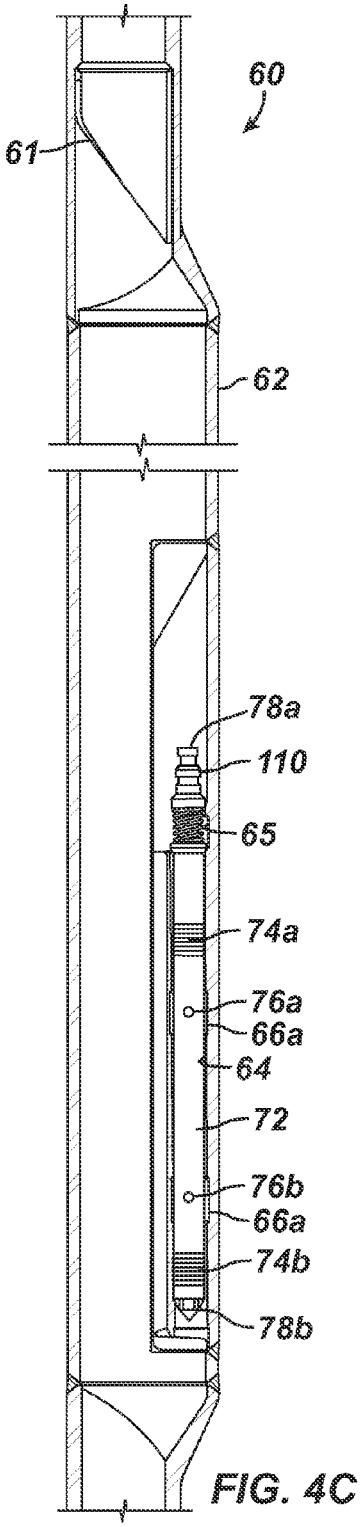
FIG. 4C shows the gas lift valve in an operating state in the mandrel.

Portion of a gas lift system according to the present disclosure is shown in FIGS. 4A-4C during various stages of operation. In general, the gas lift system has one or more mandrels 60 and has one or more gas lift valves 70 that dispose downhole on a tubing string (not shown). FIGS. 4A-4C only show one mandrel 60 and one gas lift valve 70, but the gas lift system can have several mandrels 60 and gas lift valves 70 that deploys on a tubing string in the gas lift system not unlike that discussed previously. As shown, the mandrel 60 and valve 70 can be configured for a wireline-retrievable gas lift system. However, the teachings of the present disclosure can apply equally well to a tubing retrievable gas lift system.

The mandrel 60 shown here is a side pocket mandrel having a side pocket 64 in an offset bulge 62. A suitable type of mandrel includes a McMurry-Macco® side pocket mandrel, such as the SM-2 or SFO-2 series available from Weatherford International. Depending on the type of system, however, the mandrel can be any known type of mandrel, including a conventional mandrel with an external mount for a gas lift valve.

The pocket's upper end has a seating profile 65 for engaging a latch mechanism (100; FIG. 4B) of a gas lift valve (70; FIG. 4B) or other tool, while the pocket's other end 68 may be open. Ports 66*a-b* in the mandrel's pocket 64 communicate with the surrounding annulus outside the mandrel 60 and allow for fluid communication during gas lift or other types of operations. In contrast to the conventional arrangement, the mandrel 60 can have dual sets of ports 66*a-b* as shown for gas in the surrounding annulus to enter the mandrel 60, although a single set of ports or more that two sets could be used.

As shown in FIG. 4B, a gas lift valve 70 of the present disclosure deploys in the mandrel 60 with its dual ports 66*a-b*. The gas lift valve 70 can be installed manually in the mandrel 60 during initial installation at the surface so that the mandrel 60 with installed gas lift valve 70 can be run downhole together without the need for a slickline operation to install the gas lift valve 70. However, the gas lift valve 70 may typically be lowered down the tubing string to the side pocket mandrel 60 when it is already installed downhole.

For example, a slickline operation and appropriate tool (not shown) can be used to run the gas lift valve 70 downhole in the tubing string to install it in the side pocket 64 so the valves seals 74*a-b* can straddle and packoff the mandrel's ports 66*a-b*. The mandrel 60 may also have an orienting sleeve 61 for facilitating the slickline operations and for properly aligning the gas lift valve 70 within the pocket 64. During installation, a tool discriminator (not shown) can be used to guide the gas lift valve 70 into the pocket 64 and deflects larger tools to prevent damage to the gas lift valve 70.

Shown installed in FIG. 4B, the gas lift valve 70 has dual inlet ports 76*a-b* to receive inlet gas from the mandrel's ports 66*a-b*. At its downhole end or nose, the gas lift valve 70 has an outlet 78*b* for the injected gas to leave the valve 70 and enter the tubing string. At its uphole end, the gas lift valve 70 has an outlet 78*a*, which can communicate with a port in a latch mechanism 100 for engaging in the mandrel's seating profile 65. A number of latch mechanisms 100 can be used, as discussed in more detail later. The latch mechanism 100 is ported for the injected gas to leave the valve's outlet 78*a* and enter the tubing string.

As best shown in FIG. 4C, the gas lift valve 70 in an operating state in the mandrel 60 has its outlets 78*a-b* exposed to the interior of the mandrel 60. The downhole outlet 78*b* allows injected gas to enter the mandrel's interior and coupled tubing string. Gas can also exit the outlet 78*a* at the latch mechanism 100 and enter the mandrel's interior and coupled tubing string. To do this, the latch mechanism 100 can define a permanently open port.

Alternatively, the latch mechanism 100 can have a plug 110 that can be removed from the latch's port once the gas lift valve 70 is deployed and ready for operation. (Details of latch mechanisms 100 with removable plugs are provided below with reference to FIGS. 8A-8B.) Operators can use a slickline operation to remove the plug 110 so that the upper outlet 78*a* of the gas lift valve 70 can be used. Although the plug 110 may be useful in some applications, it is not strictly necessary in other implementations so the valve 70 can lack the plug 110 altogether.

As shown in FIG. 4C, for example, operators have removed the plug 110 by pulling on the plug 110 and breaking its connection to the latch mechanism 100 using a slickline operation and appropriate tool. With the plug 110 removed, the valve's outlet 78*a* is exposed to the mandrel's interior, and the valve 70 can operate as described previously to regulate gas flow from the surrounding annulus to the tubing string.

With the gas lift valve 70 installed in the mandrel 60, double the gas injection can be achieved from the borehole annulus into the tubing string. As noted previously, some situations involving a high rate well require operators to run smaller valves (i.e., valve having 1-in. OD) downhole because of the tight casing clearance in the borehole. To improve gas injection, the operator may typically runs a mandrel with multiple pockets or run two standard mandrels separated by a joint of pipe on the tubing string in the borehole. Although double the gas passage may result, using the standard valves, pockets, and mandrels significantly complicates servicing the completion. The gas lift valve 70 of the present disclosure can provide double the gas passage without complicating the completion. In fact, the disclosed gas lift valve 70 can have a conventional outer diameter and can install in a conventional mandrel 60 as noted herein.

Figure 5:
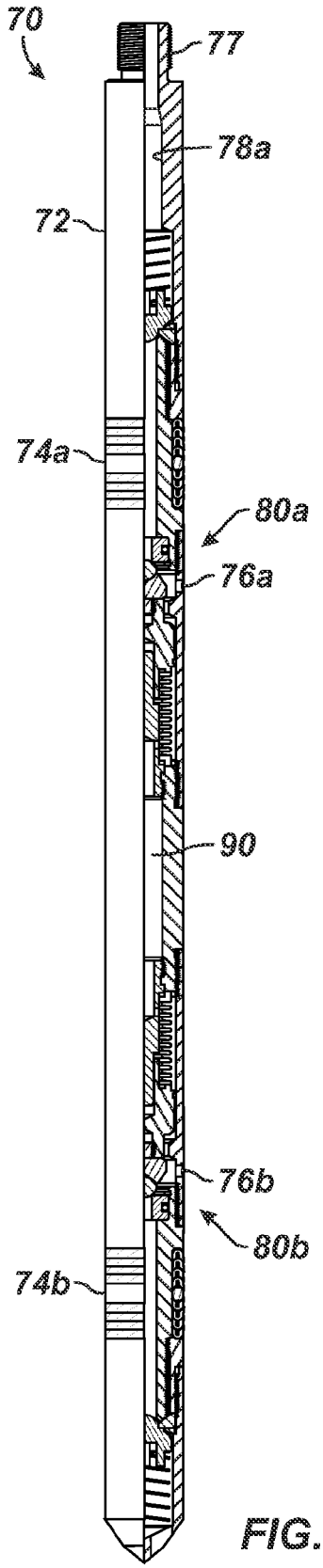
FIG. 5 shows a gas lift valve according to the present disclosure in partial cross-section.
Figure 6A:
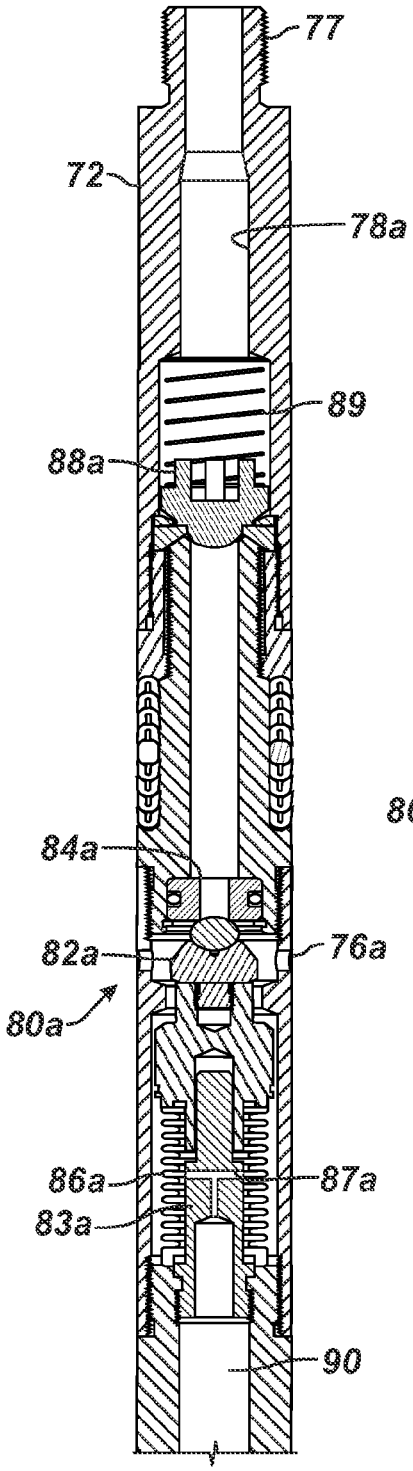
FIGS. 6A-6B show the disclosed gas lift valve in more detailed cross-section.
Figure 6B:
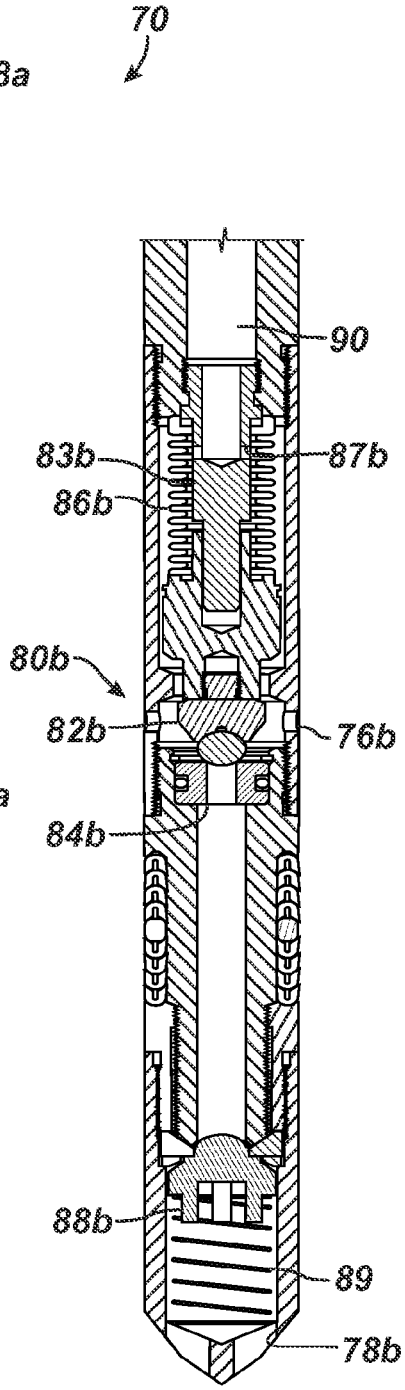

Internally, the gas lift valve 70 has two valve mechanisms to control the passage of injected gas through the valve 70 and into the tubing string. To better illustrate the valve's operation, FIG. 5 shows a gas lift valve 70 in partial cross-section, while FIGS. 6A-6B show the gas lift valve 70 in more detailed cross-sections.

The valve 70 has an elongated housing 72, which can be composed of several interconnected subassemblies as is customary in the art. In general, the housing 72 is cylindrical and can have a diameter comparable to existing gas lift valves. Yet, as noted herein, the gas lift valve 70 even with such a conventional diameter can offer higher gas injection rates due to the dual outlets 78*a-b* as discussed herein.

The gas lift valve 70 has first and second inlets 76*a-b* for receiving inlet fluid (i.e., injected gas) from the mandrel (60) and has first and second outlets 78*a-b* for injecting the gas into the mandrel (60) and tubing string. Because the valve 70 installs in a side pocket of a mandrel and may do so with a slickline operation, the top end 77 of the valve 70 can have a latch mechanism (not shown) that affixes thereto. (As discussed herein, the latch mechanism can be ported so the first outlet 78*a* can inject gas out of the valve 70.)

Externally, a first seal or packing 74*a* disposed on the housing 72 engages the mandrel (60) and isolates fluid communication outside the housing 72 between the first inlet 76*a* and the first outlet 78*a*. Similarly, a second seal or packing 74*b* disposed on the housing 72 also engages the mandrel (60) and isolates fluid communication outside the housing 72 between the second inlet 76*b* and the second outlet 78*b*. Various types of seals 72*a-b* could be used, such as the chevron seals shown.

(If the gas lift valve 70 were a tubing retrievable valve disposed on an external mount of a mandrel, the external seals 74*a-b* would not be necessary. Instead, the valve's inlets 76*a-b* could communicate directly with the annulus. Meanwhile, the valve's nose having the outlet 78*b* would typically thread into a collar on the mandrel (or thread into a check valve threaded into the mandrel's collar). The valve's other end with its outlet 78*a* would need to couple with another collar, check valve, or opening in the conventional mandrel as one skilled in the art would appreciate so the other outlet 78*a* could communicate with the mandrel's interior.)

Internally, the valve 70 has first and second valve mechanisms 80*a-b* disposed in the housing 70 to control passage of inlet gas from the inlets 76*a-b* to the outlets 78*a-b* respectively. Each valve mechanism 80*a-b* has a seat 84*a-b* disposed between the respective inlet 86*a-b* and outlet 88*a-b* and has a valve member 82*a-b* biased relative to the seat 84*a-b* to restrict passage of the inlet fluid through the seat 84*a-b*. Each valve mechanism 80*a-b* also has a check valve 88*a-b* disposed between the seat 84*a-b* and the outlet 78*a-b*. In use, the check valve 88*a-b* permits fluid communication from the seat 84*a-b* to the outlet 78*a-b* and restricts fluid communication in the reverse direction.

In the present arrangement, the gas lift valve 70 has bellows 86*a-b* that convert pressure into movement of the valve members 82*a-b*. This allows the injected compressed gas to act upon the bellows 86*a-b* to open the valve 70 and pass into the production fluid fed in from the well's producing zone. As differential pressure is reduced on the bellows 86*a-b*, the valve members 82*a-b* can close against the seats 84*a-b*.

As shown, the valve 70 uses an internal gas charge, usually nitrogen, in a volume dome to provide the closing force for the valve 70. As an alternative, the valve 70 can use non-gas charged, atmospheric bellows 86*a-b* and can use springs to close the valve mechanisms 80*a-b*. In both configurations, pressure differential on the bellows 86*a-b* from the injected high-pressure gas opens the valve mechanisms 80*a-b*.

For the volume dome, the housing 72 defines a pressure chamber 90 communicating with both of the bellows 86*a-b*. Pressurized gas, such as nitrogen, fills the chamber 90 using a port (not shown) that is plugged after filling. (Details of the port for the chamber 90 are discussed below with reference to FIG. 9.)

The dome pressure held in the pressure chamber 90 acts against both bellows 86*a-b* of the valve mechanisms 80*a-b*. In particular, one end of the bellows 86*a-b* affixes to the housing near the chamber 90, while the other end affixes to the valve members 82*a-b*. The bellows 86*a-b* each dispose on stems 83*a-b* affixed at proximal ends to the housing near the chamber 90, and the valve members 82*a-b* can reciprocate on the stems' distal ends relative to the seats 84*a-b*. Dome pressure in the chamber 90 can communicate with the inside of the bellows 86*a-b* via communication ports 87*a-b* in the stems 83*a-b*. The outsides of the bellows 86*a-b* are exposed to the inlet pressure from the inlets 76*a-b*.

An appropriate amount of oil, such as silicon oil, can also partially fill the chamber 90. The oil is intended to cover portion of the bellows' inside surfaces and protect the bellows 86*a-b* from internal-injection pressure. The oil can also prevent valve chatter due to any non-uniform injection flow or pressure. Gravity may tend to collect the oil from the chamber 90 more inside the lower bellows 86*b*. However, at least some oil can be trapped inside the upper bellows 86*a* even by gravity in the space around the stem 83*a* as long as the location of the communication ports 87*a* is disposed further towards the stem 83*a*'s distal end. Other solutions available in the art could also be used.

As an alternative to the single chamber 90, the valve 70 can have separate pressure chambers (not shown), with each having dome volume communicating with one of the bellows 86*a-b*. The separate chambers can be set to the same or different operating pressures depending on the implementation and the desired operation of the valve 70.

The valve mechanisms 80*a-b* may be configured to operate similar to one another, meaning that the valve mechanisms 80*a-b* may operate the same way under given operating conditions. In other words, the valve mechanisms 80*a-b* may essentially operate in tandem and respond similarly to the same operating pressures and may produce roughly the same gas injection rates for the outlets 78*a-b*. Thus, the bellows 86*a-b* may be the same, and the inlets 72*a-b* may be the same size. Likewise, the valve seats 84*a-b* and other components can be similarly configured.

Alternatively, the two valve mechanisms 80*a-b* may be configured to operate different from one another. In other words, the valve mechanisms 80*a-b* may respond differently to the same operating pressures and/or may produce different gas injection rates for the outlets 78*a-b*. For example, the bellows 86*a-b* may react differently to pressure, being of different sizes or the like. The inlets 72*a-b* and the valve seats 84*a-b* may be of different sizes. Additionally, as noted previously, two separate chambers can be used with each having different dome pressures. One or more of these elements may be different between the two valve mechanisms 80*a-b* so that they are configured to operate differently. This difference in operation may have advantages for some implementations in which different gas inject rates can be used to produce different gas lift results.

Figure 7A:
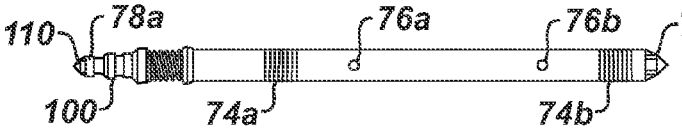
FIG. 7A shows the disclosed gas lift valve with one arrangement of seals and inlets.

In addition to the alternatives for the valve mechanisms 80*a-b*, the gas lift valve 70 can have different external seal and port arrangements. For example, the gas lift valve 70 as shown in FIG. 7A has an arrangement of seals 74*a-b* with one seal 74*a* on the uphole end and another seal 74*b* on the downhole end. The seals 74*a-b* isolate the dual inlets 76*a-b* on the gas lift valve 70 from the uphole and downhole ends of the side pocket in the mandrel. The seals 74*a-b* can be chevron seals as shown, although other types of suitable seals could be used.

Figure 7B:
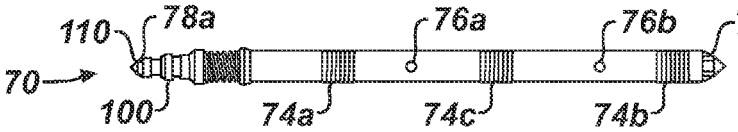
FIG. 7B shows the disclosed gas lift valve with another arrangement of seals and inlets.

As shown in different arrangement of FIG. 7B, an intermediate seal 74*c* can be disposed about the valve 70 in between the inlet ports 76*a-b* to isolate fluid communication of the mandrel's inlets 76*a-b* from one another once the valve 70 is disposed in the side pocket mandrel. This arrangement may allow the dual gas lift valve 70 to be operated more effectively as either a single injection valve or a dual injection valve. For the single injection form of operation, for example, the plug 110 on the latch mechanism 100 may be left in place after the valve 70 is deployed in the side pocket mandrel. In this way, injected gas would only pass through the downhole inlet 76*b* and outlet 78*b* for gas injection.

Being able to selectively make the gas lift valve 70 operate with either single injection or dual injection can have a number of advantages for a given implementation. For example, one or more of the gas lift valves 70 may be deployed for single injection operation, and at some later point, operators may convert them for dual injection operation depending on the circumstances. Likewise, a gas lift system may be deployed with gas lift valves configured for single and dual flow operation down the tubing string to meet a particular production need.

Figure 7C:
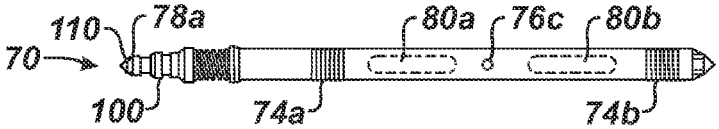
FIG. 7C shows the disclosed gas lift valve with one inlet for receiving inlet fluid.

As an additional alternative, the gas lift valve of the present disclosure can have one inlet for both valve mechanisms 80*a-c*. For example, FIG. 7C shows the disclosed gas lift valve 70 with one inlet 76*c* for receiving inlet fluid. With proper routing for fluid communication in the valve's housing 72, the one inlet 76*c* communicating with both valve mechanisms (80*a-b*) inside the valve 70. To do this, passages and spaces (not shown) in the housing 72 around the outside of the inner components of the valve 70 of FIG. 5 can convey inlet fluid from the one inlet 76*c* to the valve mechanisms (80*a-b*) inside the valve 70. Thus, the valve 70 can have a pair of seals 74*a-b* disposed thereon to isolate the one inlet 76*c* from the mandrel (60) when deployed therein. In a complementary fashion, the mandrel (60) may also have a single port or set of ports (66) communicating with the annulus.

As noted previously, the gas lift valve 70 has a latch mechanism 100 used to deploy the valve in the side pocket (64) of the mandrel (60). The latch mechanism 100 can have a permanently open port or may have a plug removably disposed in the port. One type of latch mechanism 100*a* shown in FIG. 8A is a ring-style latch used to install and retrieve the valve 70 in a side pocket mandrel, while another type of latch mechanism 100*b* in FIG. 8B is a collet-type latch.

Figure 8A:
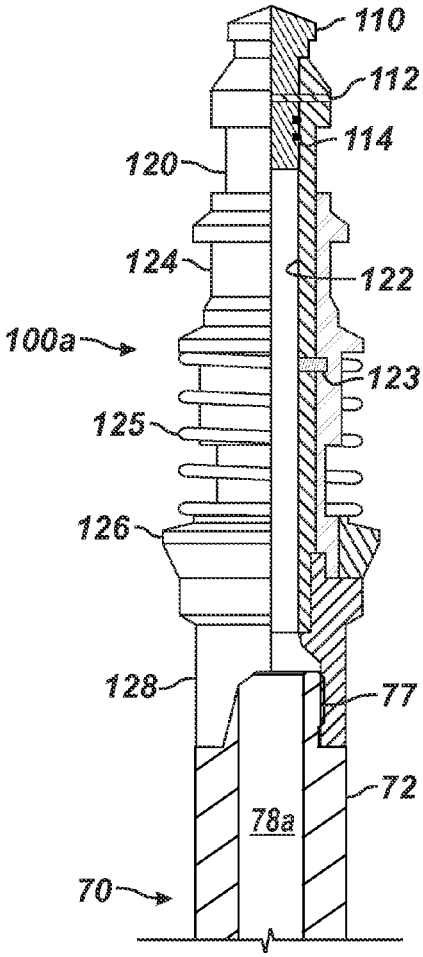
FIG. 8A shows one type of latch mechanism with a removable plug disposed on the end of the disclosed gas lift valve.

The latch mechanism 100*a* of FIG. 8A has ring-style locking mechanism with a central core 120 attached by a coupling member 128 to the threaded end 77 of the gas lift valve's housing 72. A sleeve 124 movable on the core 120 is biased by a spring 125. The sleeve 124's lower end can move relative to a ring 126 allowing the ring 126 to engage or disengage from a complementary lock profile of a side pocket mandrel. A shear pin 123 initially holds the sleeve 124 in position on the central core 120.

For closing off the outlet 78*a* on the gas lift valve, a plug 110 can dispose in an internal passage 122 of the central core 120. The plug 110 uses a shear pin 112 and O-rings 114 as a temporary connection to seal the valve's outlet 78*a*. In some installations, however, such a plug 110 may not be used so that the latch mechanism 100*a* can remain permanently opened.

Figure 8B:
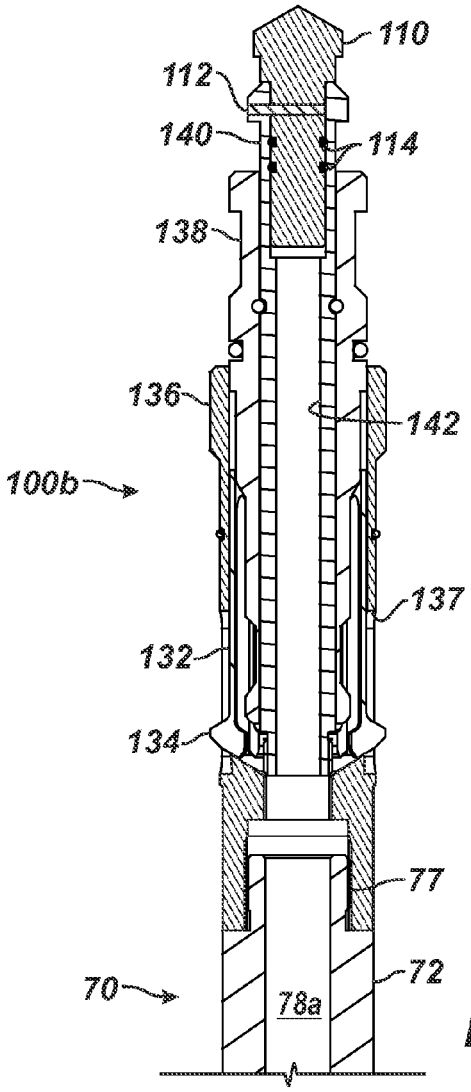
FIG. 8B shows another type of latch mechanism with a removable plug disposed on the end of the disclosed gas lift valve.

The collet-type latch mechanism 100*b* of FIG. 8B attaches to the threaded end 77 of the valve's housing 72. The latch mechanism 100*b* uses a collet-type locking mechanism similar to a MT-2 style latch used for installing slickline retrievable valves in side pocket mandrels. The latch mechanism 100*b* can lock in a 360-degree latch-pocket profile of a mandrel (See e.g., profile 65 in FIG. 4A).

For this collet-type arrangement, the latch mechanism 100*b* has a collet 132, a latch housing 136, a latch sleeve 138, and a central core 140. The collet 132 is movably positioned on the sleeve 138, and the sleeve 138 is movably positioned on the central core 140. For its part, the central core 140 affixes inside the latch housing 136, and the latch housing 136 affixes to the valve's distal end 77.

Biased latch lugs 134 on the collet 132 can move within slots 137 in the latch housing 136. Manipulation of the latch sleeve 138 changes its position along the central core 140 and either permits or restricts the extension or bending of the biased lugs 134 in the slots 137. Depending on the orientation of the core's profile and the collet 132, the lugs 134 can catch on an appropriate latch-pocket profile (65) of a side pocket mandrel (60) (See e.g., FIG. 4A) to hold the valve 70 in place.

As before, a plug 110 can dispose in an internal passage 142 of the central core 140. The plug 100 uses a shear pin 126 and O-rings 127 as a temporary connection to seal the valve's outlet 78*a*. In some installations, however, such a plug 110 may not be used so that the latch mechanism 100*b* can remain permanently opened.

Figure 9:
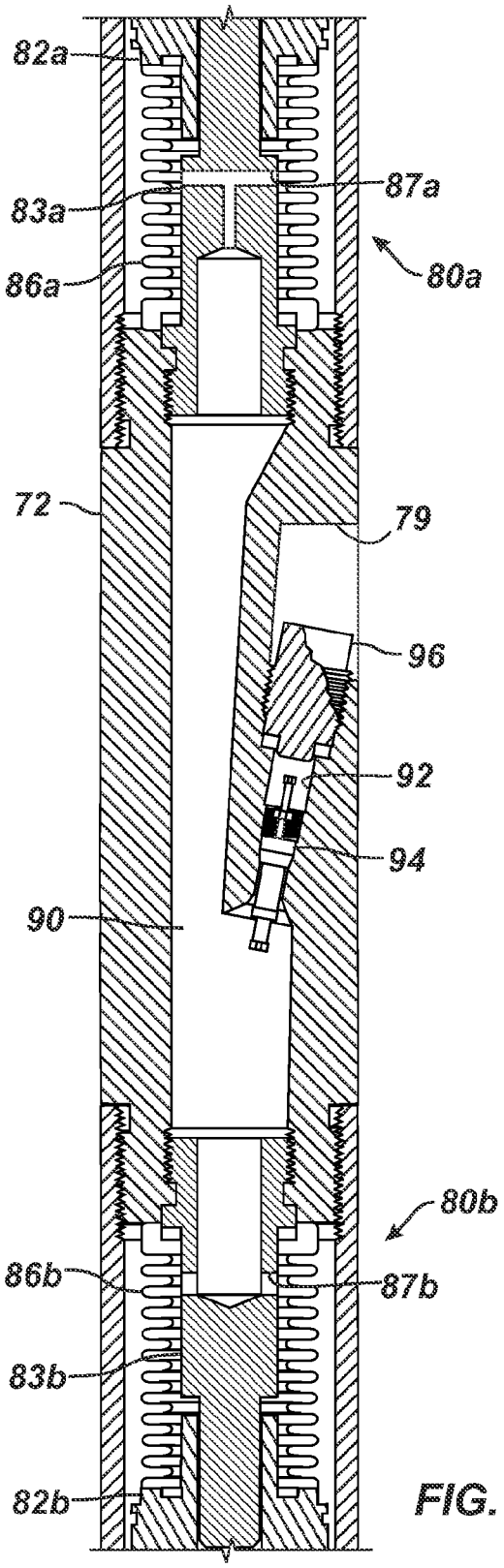
FIG. 9 shows a portion of the housing having a port for filling the chamber.

As noted previously, the chamber 90 of the gas lift valve 70 is filled with a pressure charge, typically nitrogen. Conventionally, a core valve is used to fill a pressure dome in a gas lift valve. Such a core valve is typically used at the top end of the valve where the pressure dome is usually located. Because the chamber 90 on the disclosed valve 70 is situated at an intermediate portion of the valve 70, the port for filling the chamber 90 is modified from the typical arrangement. As shown in FIG. 9, for example, a recess 79 in the housing 72 defines a port 92 communicating with the chamber 90. A core valve 94 installs in this port 92, and a plug 96 threads in the port 92 behind the core valve 94 for additional sealing. The core valve 94 can be up to ½-inch in length so the port 94 may be angled to better fit the valve's diameter. Other port mechanisms and check valve for filing the chamber with pressurized gas and subsequent sealing could also be used, as will be appreciated with the benefit of the present disclosure.

In previous arrangements, the valve mechanisms 80*a-b* use bellows to operate. As an alternative, the gas lift valve 70 of FIG. 10 uses bellows 86*a-b* and springs 98*a-b* to operate the two valve mechanisms 80*a-b*. (Similar reference numerals are used for similar components to those associated with the valve disclosed above.) As shown, the valve 70 has the elongated housing 72 having external packings 74*a-b* for engaging the mandrel, inlets 76*a-b* for receiving inlet fluid, and outlets 78*a-b* for injecting the gas. The top end 77 can have a latch mechanism (not shown) that affixes thereto.

Internally, the valve 70 has valve mechanisms 80*a-b* to control passage of inlet gas from the inlets 76*a-b* to the outlets 78*a-b* respectively. Each valve mechanism 80*a-b* has a seat 84*a-b* disposed between the respective inlet 86*a-b* and outlet 88*a-b* and has a valve member 82*a-b* biased relative to the seat 84*a-b* to restrict passage of the inlet fluid through the seat 84*a-b*. Each valve mechanism 80*a-b* also has a check valve 88*a-b* disposed between the seat 84*a-b* and the outlet 78*a-b*.

The gas lift valve 70 has bellows 86*a-b* and springs 98*a-b* to operate the valve mechanisms 80*a-b*. The bellows 86*a-b* are non-gas charged, atmospheric bellows separating inlet pressure at the inlets 76*a-b* from atmospheric chambers 90*a-b* in which the springs 98*a-b* dispose. Intermediate elements 91 disposed in the valve 70 isolate the chambers 90*a-b* from one another. If desired, fluid communication between the chambers 90*a-b* could be provided through a flow channel (not shown) in the elements As an additional alternative, the valve 70 of FIG. 10 may operate using the springs 98*a-b* without the bellows 86*a-b*. This would merely require modifying the valve 70 of FIG. 10 to exclude those features associated with the bellows 86*a-b*. In this way, only the springs 98*a-b* would be intended to operate the valve mechanisms 80*a-b* of the valve 70.

Figure 10:
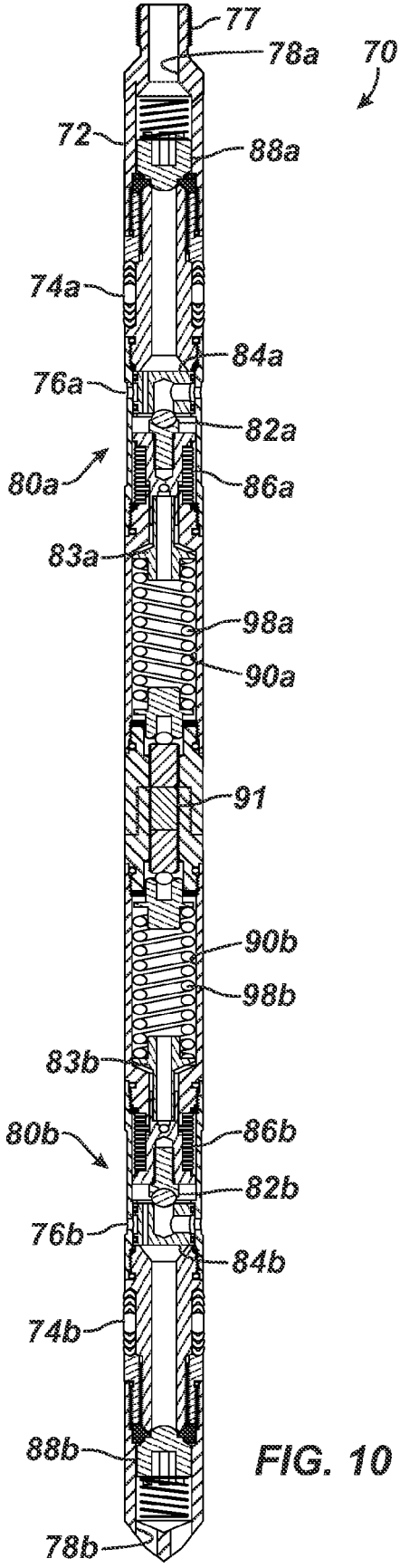
FIG. 10 shows a gas lift valve of the present disclosure having two valve mechanisms that use springs and bellows.

In yet another alternative, the valve 70 of FIG. 10 may use a mixed combination of spring and gas-charged bellows to operate the valve mechanisms 80*a-b* and control passage of inlet gas from the inlets 76*a-b* to the outlets 78*a-b*, respectively. For example, the lower valve mechanism 80*b* may use a bellows 86*b* and a gas charged dome in chamber 90*b* without a spring (98*b*) in an arrangement similar to the mechanism 80*b* discussed previously with reference to FIG. 6B. Yet, the upper valve mechanism 80*a* may use a spring 98*a* and non-gas charged bellows 86*a* in an arrangement similar to the mechanism discussed above with reference to FIG. 10. Alternatively, only the spring 98*a* could be used without the bellows 86*a*. The valve could also reverse arrangements of these mixed types of mechanisms 80*a-b*.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A gas lift method, comprising:

deploying a gas lift valve downhole in a mandrel;

biasing a first valve mechanism in the gas lift valve to a closed condition restricting fluid communication from at least one inlet to a first outlet of the gas lift valve;

basing a second valve mechanism in the gas lift valve to a closed condition restricting fluid communication from the at least one inlet to a second outlet of the gas lift valve;

communicating fluid outside the mandrel through the at least one inlet in the gas lift valve;

initially operating the gas lift valve in a single injection operation by controlling passage of inlet fluid from the at least one inlet to the first outlet with the first valve mechanism responsive to fluid pressure at the at least one inlet and by preventing inlet fluid from passing out a second outlet of the gas lift valve with a removable plug at the second outlet;

subsequently operating the gas lift valve in a dual injection operation by controlling passage of inlet fluid from the at least one inlet to the first outlet with the first valve mechanism responsive to fluid pressure at the least one inlet, by removing the plug from the second outlet, and by controlling passage of inlet fluid from the at least one inlet to the second outlet with the second valve mechanism responsive to fluid pressure at the at least one inlet; and preventing, in both the single and dual injection operations, fluid in the mandrel from passing through the gas lift valve from the first and second outlets to the at least one inlet.

2. The method of claim 1, wherein deploying the gas lift valve downhole on the mandrel comprises engaging a latch on the gas lift valve in a profile defined in the interior of the mandrel.

3. The method of claim 1, wherein biasing the first valve mechanism comprises biasing a first valve member relative to a first seat communicating the at least one inlet with the first outlet.

4. The method of claim 3, wherein biasing the first valve member relative to the first seat comprises biasing the first valve member with a spring disposed in the gas lift valve.

5. The method of claim 3, further comprising holding a stored pressure in the gas lift valve, wherein biasing the first valve member relative to the first seat comprises moving the first valve member with a bellows separating inlet pressure from the stored pressure.

6. The method of claim 1, wherein controlling passage of inlet fluid from the at least one inlet to the first outlet and to the second outlet comprises biasing the first and second valve mechanisms with a same stored pressure in the gas lift valve.

7. The method of claim 2, the latch has a port in fluid communication with the second outlet and receiving the removable plug therein.

* * * * *